US005645313A

United States Patent [19]

Best et al.

[11] Patent Number: 5,645,313

[45] Date of Patent: Jul. 8, 1997

[54] DENTIST'S OR OTHER CHAIRS

[76] Inventors: Robert Edward Best, 30, Grovebury Court, Chase Road, Southgate London, United Kingdom, N14 4SR; Gordon Allen Lawrence, 1, Cedar Lawn Avenue, Barnet, Herts,, United Kingdom, EM5 2LW

[21] Appl. No.: 331,609

[22] PCT Filed: May 6, 1993

[86] PCT No.: PCT/GB93/00938

§ 371 Date: Jan. 6, 1995

§ 102(e) Date: Jan. 6, 1995

[87] PCT Pub. No.: WO93/21887

PCT Pub. Date: Nov. 11, 1993

[30] Foreign Application Priority Data

May 6, 1992 [GB] United Kingdom ..... 9209787

[51] Int. Cl.[6] ..... A47C 1/02; A61G 15/02; A61G 15/04; A61G 15/06

[52] U.S. Cl. ..... 297/68; 297/69; 297/84; 297/330; 297/354.13

[58] Field of Search ..... 297/68, 69, 83, 297/354.13, 330, 423.3, 84, 86

[56] References Cited

U.S. PATENT DOCUMENTS

| | | | |
|---|---|---|---|
| 3,792,905 | 2/1974 | Johnson | 297/330 |
| 3,804,460 | 4/1974 | Leffler | 297/330 |
| 4,696,512 | 9/1987 | Burnett et al. | 297/69 |
| 5,315,726 | 5/1994 | Borenstein | 297/354.13 |
| 5,474,359 | 12/1995 | Muffi | 297/69 |

FOREIGN PATENT DOCUMENTS

| | | | |
|---|---|---|---|
| 0223107 | 10/1924 | United Kingdom | 297/68 |

*Primary Examiner*—Peter M. Cuomo
*Assistant Examiner*—Anthony D. Barfield

[57] ABSTRACT

A dentist's or other chair has a reclining mechanism interlinking the back rest (36), the chair seat (34) and a leg or foot rest (38) for raising and reclining the back rest (36), for tilting the chair seat (34), and for lowering and raising the leg or foot rest (38) together. In order to be able to recline the chair so that its seat (34), back rest (36) and leg or foot rest (38) are both flat and horizontal, the mechanism includes means for disengaging the chair seat so that with the chair seat disengaged and horizontal, the back rest (36) can be reclined and the leg or foot rest (38) can be raised both also to horizontal.

9 Claims, 10 Drawing Sheets

DENTIST'S OR OTHER CHAIRS

This invention relates to jacks and to dentist's or other chairs.

There are times when it is desired to recline a dentist's or other chair completely, e.g. for use as an operating table for minor surgery. For such use it is desirable that the back rest, the seat and the leg rest should all be in the same horizontal plane. That contrasts with normal reclined use in which the seat tilts as the back reclines to a non-horizontal position. Electrically driven chairs,, for example, have only achieved the horizontal plane by use of two motors, one driving the back and leg rests and the other driving the seat. Known chairs, in which the reclining mechanism is driven by a single motor, suffer the problem, that as the back is reclined and the leg or foot rest is raised, the chair seat also tilts, so that to get all three flat, the back and the leg or foot rest must be positioned beyond horizontal to align with the chair seat. This usually produces a tilt of about 15 degrees to horizontal with the head lower than the feet.

Against this background, a first aspect of the invention provides a dentist's or other chair having a reclining mechanism interlinking the back rest, the chair seat and a leg or foot rest for raising and reclining the back rest, for tilting the chair seat, and for lowering and raising the leg or foot rest together, the mechanism including means for disengaging the chair seat so that with the chair seat disengaged and horizontal, the back rest can be reclined and the leg or foot rest can be raised both also to horizontal.

By disengaging the tilt mechanism, the chair may be reclined to a flat position which is horizontal, even if driven by a single electric motor.

In a preferred arrangement, said seat is mounted for tilting movement relative to a base, and the mechanism comprises a shaft mounted in the chair seat, a crank mounted fixedly on the shaft for rotation therewith and connected pivotally to the base, so that rotation of the shaft also tilts the chair seat.

In that arrangement, the means for disengaging the chair seat may comprise means for selectively disconnecting the crank from the base so that the leg or foot rest may be selectively raised without tilting the chair seat.

Conveniently, the mechanism may include a linkage comprising a crank mounted fixedly on the shaft for rotation therewith, an arm mounted for pivotal movement with the leg or foot rest and a link pivotally connected at one end to the crank and at the other end to the arm so that rotation of the shaft produces a pivotal movement in the arm to raise or lower the leg or foot rest.

In order that the dentist does not get, say, her or his knee trapped beneath the leg or foot rest when that is being lowered, the mechanism preferably includes a second arm mounted in fixed relationship to the first mentioned arm for movement therewith and against which the leg or foot rest is located so that it may be raised relative to the second arm or may be held back as the second arm moves in a leg or foot rest lowering direction.

If the back rest is merely pivoted, as it reclines it pivots about a different centre from that about which the patient's back pivots, namely her or his hip joints. This leads to the patient's back sliding on the back rest which is uncomfortable and may, for example, pull the patient's shirt out of her or his waist band.

To reduce this problem, the back rest preferably depends from a generally arcuate member which is mounted for arcuate movement so as to raise and lower the back rest, the arcuate member including gear teeth arranged around the arc thereof in engagement with a gear wheel driven by the electric motor, when engaged. If the arcuate member has a radius of about 9 inches and is correctly positioned the movement of the back will be about a centre approximately coincident with the patient's hip joints, so reducing or removing the sliding movement between the patient's back and the back rest.

In one arrangement, the generally arcuate member is mounted between rollers for said arcuate movement.

The mechanism preferably includes a shaft driven by a gear train driven from a common gear with the generally arcuate member so that movement of the generally arcuate member and the shaft are interlinked when the motor is disengaged, and a linkage arranged to translate rotation of the shaft into pivotal movement to lower and raise the leg or foot rest.

Dental and other chairs often have arm rests and it may be desirable to lower these as the chair is reclined.

To this end, the chair preferably has arm rests mounted on the chair seat by parallel links pivotally connected at one end to the chair seat and at the other end to the arm rest, one of said links being mounted for movement with rotational movement of the shaft so that movement thereof raises or lower the arm rests whilst they remain generally horizontal.

So that the dentist does not get trapped beneath an arm rest when the chair is being lowered, said one link is preferably pivotally mounted on the shaft, being raised by engagement with an arm mounted fixedly on the shaft for movement therewith, so that the arm rest may be lifted relative to the shaft mounted arm and so that the arm rest may be held back when the shaft is rotated in an arm rest lowering direction.

A second aspect of the invention also relates to dentist's or other chairs. Considering the case of a dentist, although the situation may arise in other applications, a significant number of people are sufficiently affected by the various operations that they are liable to faint. One example which leads to this condition is needle phobia. It is usual for dental surgery to be carried out under local anaesthetic which is administered by injection, leading to such patients fainting. Usual treatment is to lay the patient out flat. As the situation is an emergency, it is desirable to do that quickly. Present dentist's chairs are limited in the speed at which they operate, however.

Against this background, a second additional or alternative aspect of the invention provides a dentist's or other chair having a reclining mechanism for raising and reclining the back rest the mechanism being driven by an electric motor and including means for disengaging the electric motor to enable the back rest to be lowered manually in an emergency.

In a most preferred option, the second aspect of the invention provides a dentist's or other chair having a reclining mechanism interlinking the back rest and a leg or foot rest for raising and reclining the back rest and for lowering and raising the leg or foot rest together, the mechanism being driven by an electric motor and including means for disengaging the electric motor to enable the back rest to be lowered manually in an emergency, simultaneous with the leg or foot rest being raised by the interlinking mechanism.

By disengaging the tilt mechanism, the chair may be reclined to a flat position which is horizontal.

Dentist's and other chairs or tables are required with a lifting mechanism for raising and lowering the level of the seat. Such chairs or tables which, when the context permits, in order to avoid undue repetition, will be referred to herein generally as "dentist's chairs", are known with a hydraulic lifting mechanism. Hydraulics, however, have a tendency to leak oil which, even in small amounts, is not wanted on the floor of a dentist's surgery. Electrically driven lifting mechanisms have been proposed, but these have suffered a limitation of the range through which the chair seat can be lifted. Thus, in order to lift the seat to a desirable upper limit, the lower limit to which the seat may be lowered has been undesirably high.

A third aspect of the invention provides a new jack mechanism which has application as the lifting mechanism for dentist's or other chairs. This aspect of the invention is not limited to such chairs, however, and other applications may occur to the reader.

In accordance with the third aspect of the invention there is provided a jack comprising:

a) two end members to be urged apart or towards each other by relative movement generally parallel to a first axis;

b) a mechanism comprising: two pairs of elongate members each having first and second ends, one pair of elongate members being associated with each end member, a first elongate member of each pair having its first end connected pivotally to the associated end member, a second elongate member of each pair having its first end connected to the associated end member for pivotal movement and for linear movement relative thereto in a direction generally parallel to a second axis, normal to the first axis, the first elongate member of each pair being pivotally connected between its ends to the second elongate member of the pair between its ends, the second end of each elongate member of one pair being pivotally linked to the second end of an elongate member of the other pair; and c) a drive screw and nut arrangement driven by an electric motor for opening and closing the mechanism.

In one arrangement, the drive screw or nut is mounted for movement with one pair of linked second ends and the nut or the drive screw is mounted for movement with the other pair of linked ends. Referring to the particular application of dentists' chairs, where these have used a drive screw this has been located parallel to the first axis, i.e. vertically. This results in the limit to which the two end members can be closed being determined by the length of the screw and its driving motor. Given a certain requirement for the maximum height that determines the length of screw required, with the result that the minimum height is therefore limited by the length of the screw. In contrast, a jack in accordance with the present arrangement, has its drive screw oriented transverse to the axis so that the minimum spacing to which the end members may be closed is not limited by the length of the screw.

In another arrangement, the drive screw or nut is mounted for movement with one pair of linked second ends and the nut or the drive screw is mounted on one of said end members. Although this may result in the drive screw being oriented generally parallel to the first axis (vertical in the case of a dentist's chair) the arrangement of two pairs of elongate members produces a range of lift double the effective length of the drive screw which is normally sufficient. This arrangement has the advantage that the motor lifts the chair more effectively even from the position when the jack is fully closed.

Especially in the case of a dentist's or other chair, but also more generally, a laterally stable arrangement may be provided by a second mechanism having elongate members spaced from and parallel to those of the first mentioned mechanism, said second mechanism connecting said two end members and being driven by the drive screw and nut arrangement in common with the first mentioned mechanism.

The jack preferably includes two link members to link said pairs of second ends which are pivotally connected to the respective link members at spaced centres, the lead screw being mounted on one link member and the nut being mounted on the other.

Especially in the case of a dentist's chair, it is desirable for the jack to provide a support which is as rigid as possible for the chair, so that it is firm and does not wobble. In order improve stability, the jack preferably includes means separate from the lead screw for aligning the link members in a predetermined orientation relative to the end members.

In one arrangement, the means for aligning the link members includes a guide fixed in relation to one link member for guiding movement of the other link member.

In a preferred arrangement, the guide comprises a rod or bar slidable in a bearing in said other link member.

The means for aligning the link members may include a further elongate member pivotally connected between a link member and an end member parallel to a first or second elongate member.

In order to provide said pivotal movement and linear movement each second elongate member may be pivotally connected to a traveller which is constrained to linear movement relative to the respective end member by a guide.

The guide preferably comprises a rod or bar which is received in a bearing in the traveller.

Embodiments of the invention will now be described, by way of example, with reference to the accompanying drawings, in which.

Figure 1:
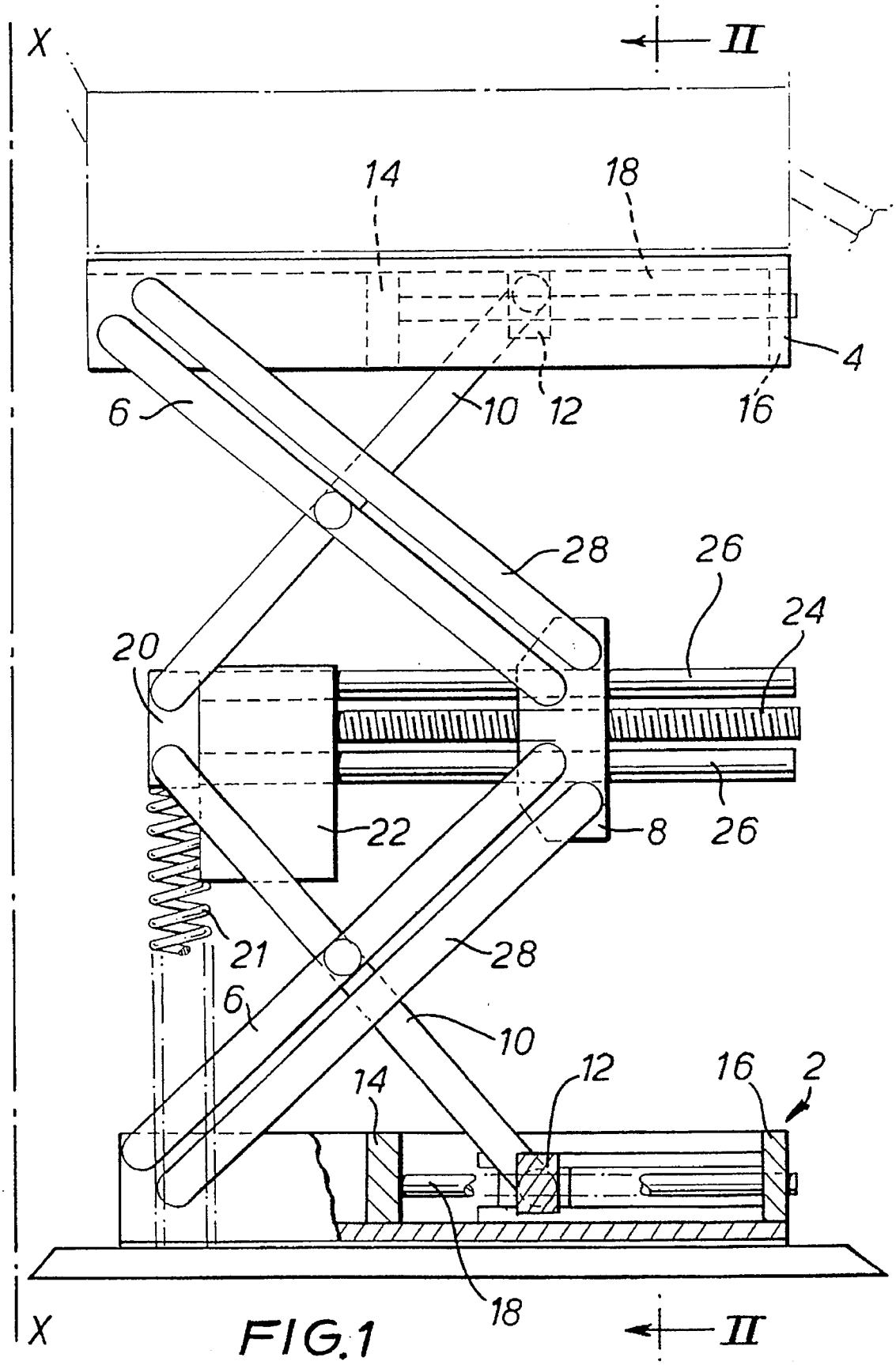
FIG. 1 is a side view of a partly extended jack embodying the invention and being the lifting mechanism for a dentist's chair.
Figure 2:
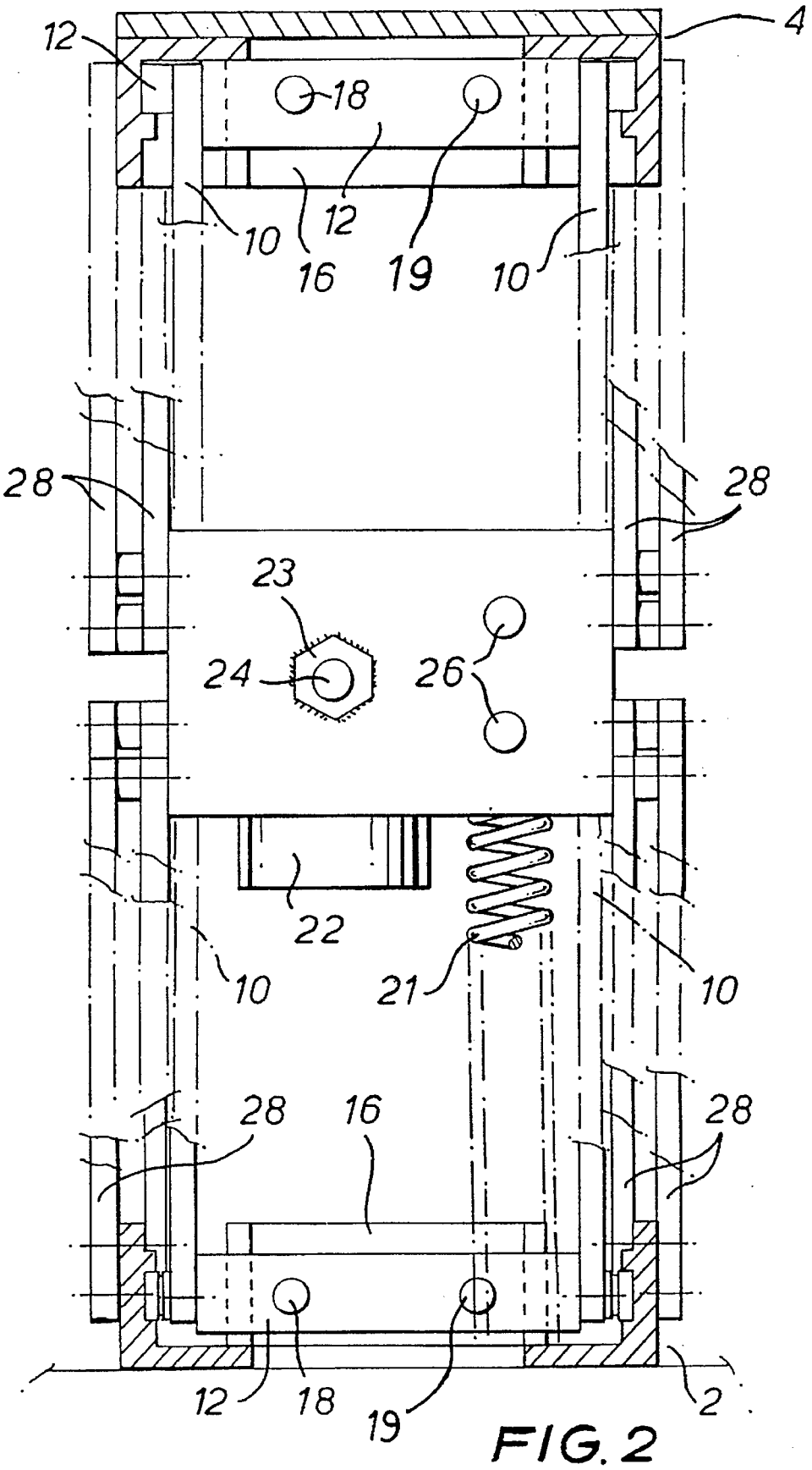
FIG. 2 is a cross section on arrows II—II of FIG. 1.
Figure 3:
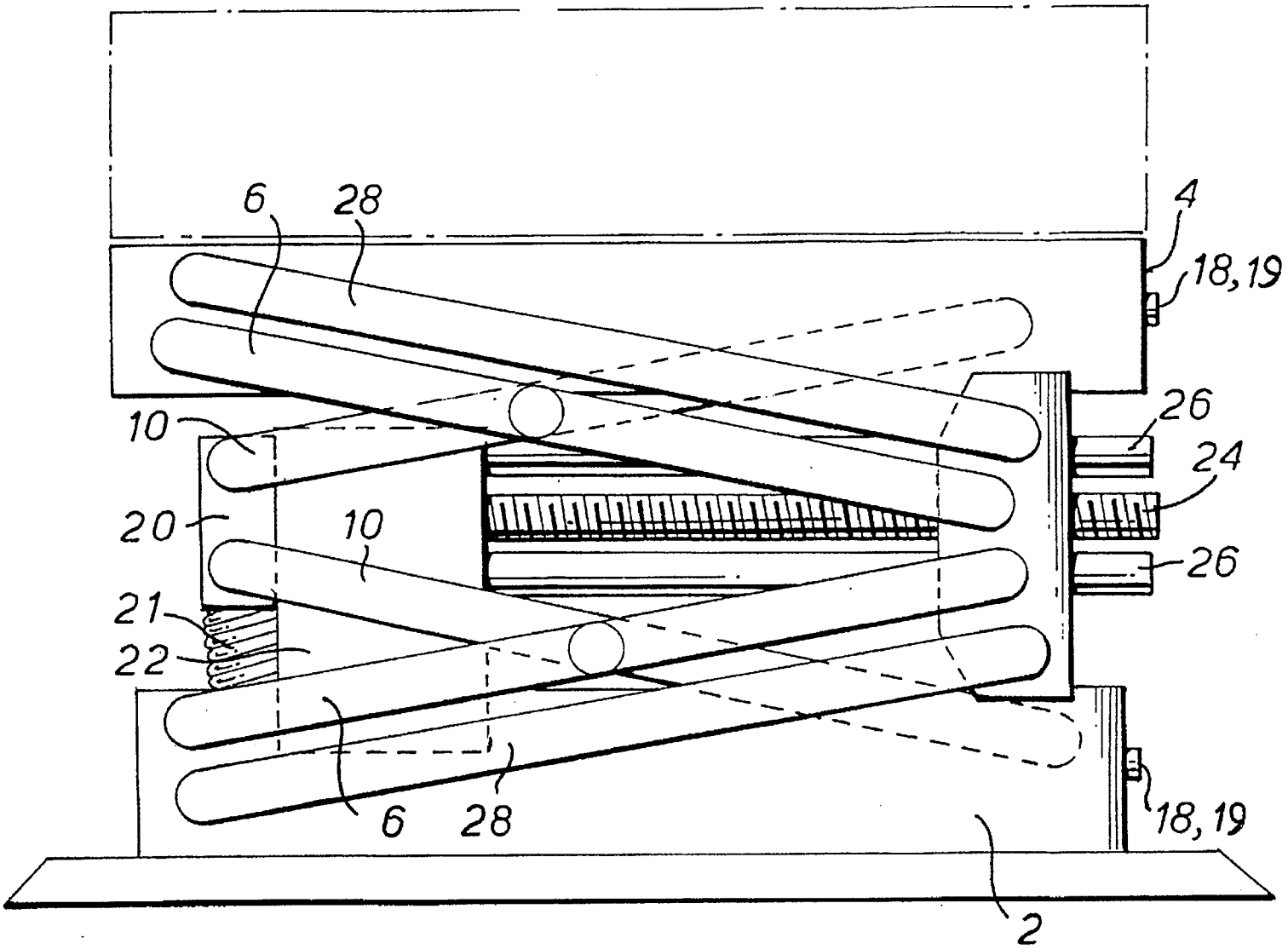
FIG. 3 is a view, similar to that of FIG. 1 but showing the jack fully retracted.

Referring to FIGS. 1 to 3 of the drawings, the jack is incorporated into an extending pedestal of a dentist's chair. The jack has two end members, which are urged apart or towards each other in a direction generally parallel to a vertical axis X—X, by operation of the jack, the end members being a base 2 and a chair seat support 4. In the particular example of a dentist's chair, the jack has two parallel mechanisms for urging the base and the chair seat support together or apart, these being generally in the form of a double X one on each side of the pedestal, see FIG. 2. In other applications where the jack is not intended to provide much lateral stability, only one of the mechanisms may be sufficient. For simplicity, only one of the mechanisms will be described, it being understood that the other is similar except where indicated.

One end of a respective elongate member 6 is pivotally mounted at one end of both the base 2 and the seat support 4. As can be seen from FIG. 2, the elongate members 6 are doubled in pairs. The other ends of both members 6 are pivotally connected to a link in the form of a block 8.

One end of a respective elongate member 10 is pivotally mounted on a bearing member in the form of a block 12 in both the base 2 and the seat support 4. Cross members 14 and 16 support respective ends each of two guide rods 18 and 20. As may be seen in FIG. 2, the guide rods 18 and 19 are slidably received by holes through the block 12 so as to guide the block. The end of each elongate member 10 is thus connected to the associated end member for pivotal movement and for linear movement relative thereto in a generally horizontal direction, i.e. generally normal to the vertical axis X—X. The other ends of the elongate members 10 are pivotally connected to a link in the form of a block 20.

The upper and lower elongate members 6 are each pivotally connected to the approximate mid point of the upper and lower elongate members 10 respectively, to produce the X-shape referred to earlier.

An electric motor and reduction gear box 22 is mounted on the block 20 for movement therewith. The gear box drives a drive screw which threadedly engages an internal thread in the block 8. The internal thread may be provided by a nylon nut 23.

Operation of the electric motor rotates the drive screw 24 so urging the block 20 and the block 8 towards each other or apart dependent on the direction of rotation of the screw. As the blocks 8 and 20 are drawn together, the seat support 4 is lifted. As the blocks 8 and 20 are moved apart, the seat support 4 is lowered, the lowest position being shown in FIG. 3.

In order to increase the rigidity of the structure, especially when extended, two guide rods 26 are fixedly mounted in the block 20 and extend slidably through respective bearing bores in the block 8. This orients the blocks 8 and 20 accurately in relation to the base and seat support. If the blocks were allowed to rotate to any substantial degree the seat support 4 would wobble significantly.

Alignment between the base 2, the block 8 and the seat support 4 is further maintained by pairs of further elongate members 28 pivotally connected by their ends between the base 2 and the block 8, or the seat support 4 and the block 8. As may be seen from the FIG. 1, the pivots of each elongate members and the adjacent elongate member 28 are arranged at the corners of a parallelogram so as to maintain the orientation of the block 8 relative to the base 2, and to maintain the orientation of the seat support 4 relative to the block 8, as the seat support is raised and lowered.

In the lowered position shown in FIG. 3, the effort required from the motor to lift a given load is rather greater than that required when the jack is, say, in the position shown in FIG. 1. In order to assist the motor from the fully lowered position, a compression spring 21 is provided between the block 20 and the base 2. As may be seen in FIG. 3, the spring is fully compressed in the lowered position and provides a lifting force to assist the motor. In addition, or alternatively, one or more compression springs may be provided between the block 8 and the block 12. The assistance of the compression spring or springs is not needed when the jack is significantly extended and the spring illustrated in FIG. 1 is at its fullest extend without being put in tension. Further extension of the jack, i.e. lifting of the chair, separates the block from the spring 21.

Figure 4:
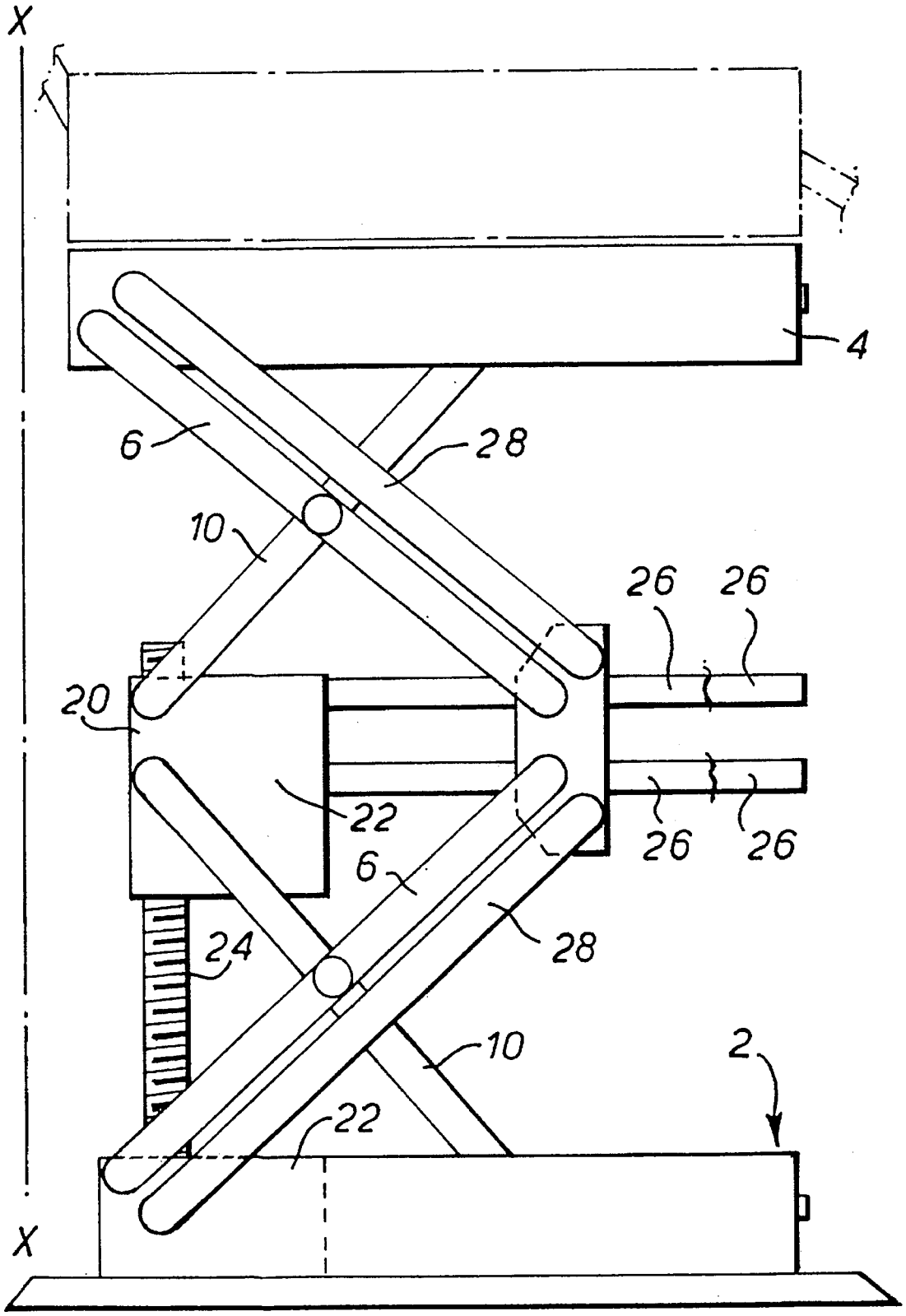
FIG. 4 is a side view, similar to that of FIG. 1, of an alternative jack embodying the invention.
Figure 6:
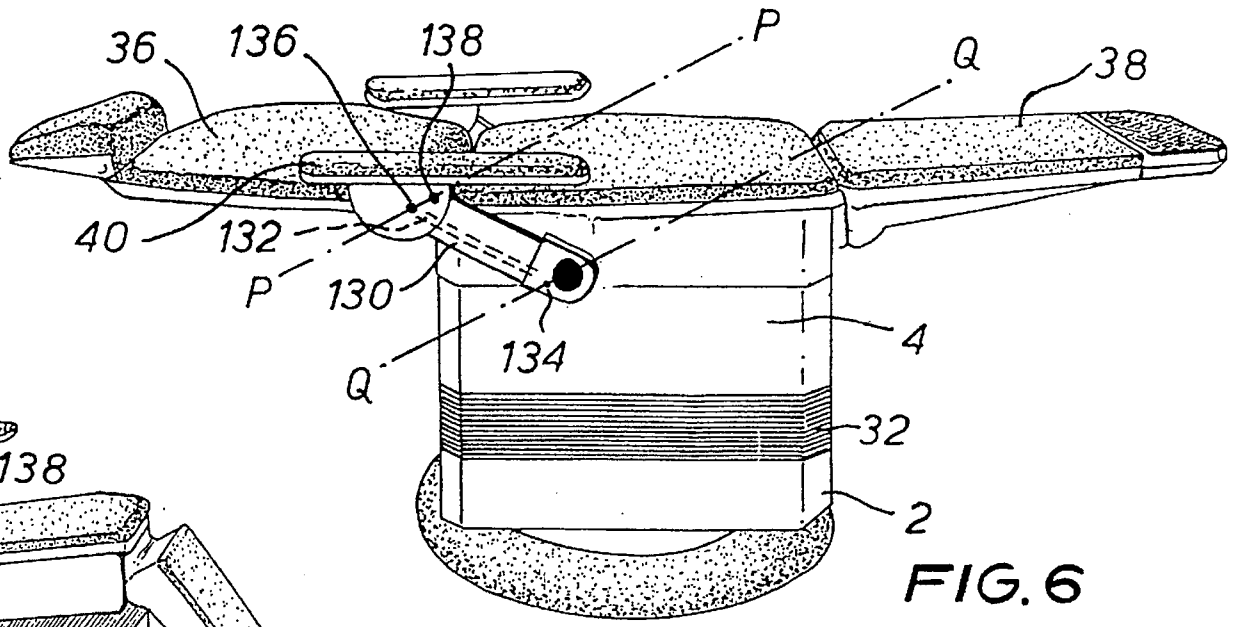
FIG. 6 is a pictorial view showing the chair of FIG. 5 fully lowered and fully reclined with the chair seat flat.

Referring to FIG. 4, an arrangement is shown which is similar to that of FIG. 1, except in orientation of the motor and gear box 22 and the drive screw 24 and in the provision of two additional guide rods 26 making four in total as illustrated. The axis of the drive screw 24 is parallel to the axis X—X and the motor 20 is fixed in the base 2. As can be seen from FIG. 4, the height to which the seat support can be raised is approximately twice the effective length of the drive screw In the dentist's chair illustrated, the jack is covered by a bellows 32, which is shown with the seat raised and lowered in FIGS. 5 and 6 respectively.

The seat 34 of the dentist's chair is mounted on a base in the form of the seat support 4 and contains a mechanism for reclining and raising a back rest 36, raising and lowering a leg and foot rest 38, lowering and raising arm rests 40, and tilting the seat 34.

Figure 7:
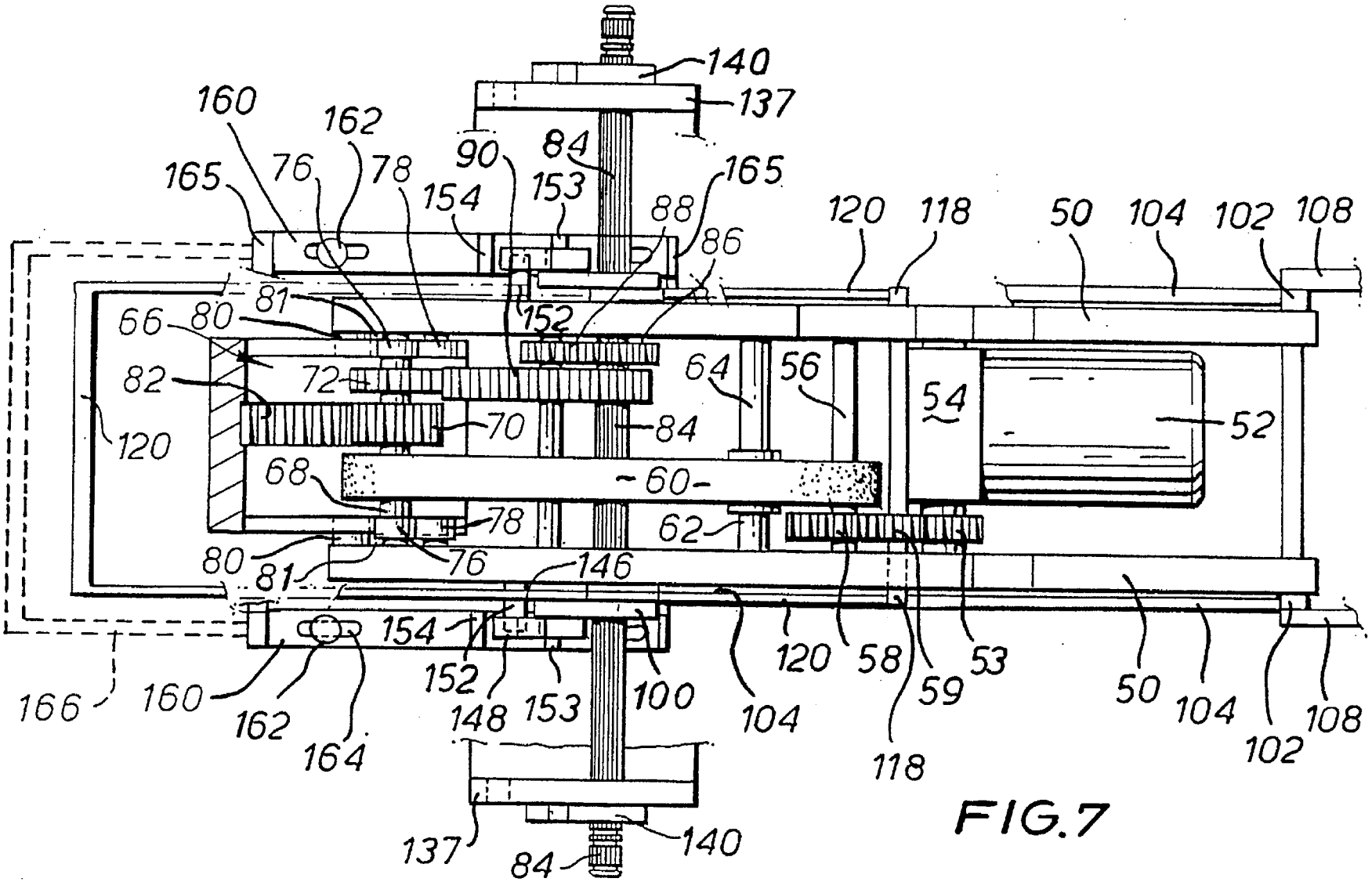
FIG. 7 is a plan view of a mechanism embodying the invention for reclining the chair.
Figure 8:
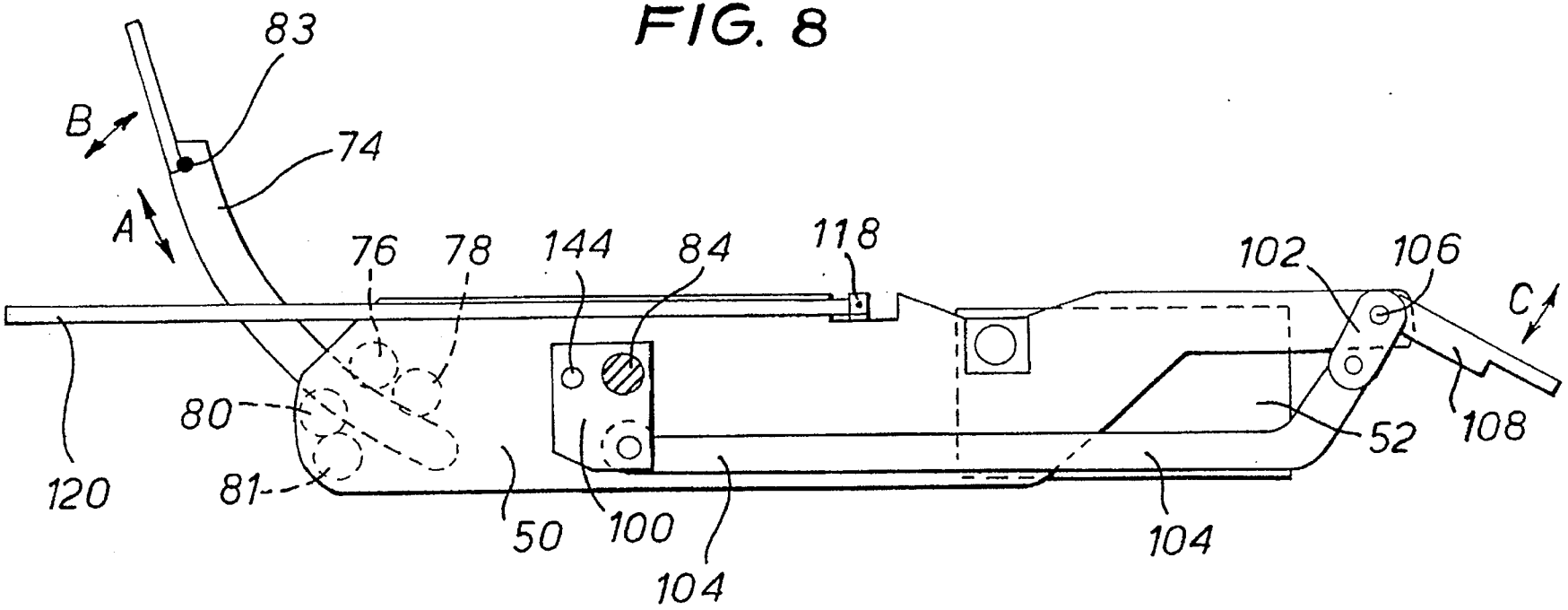
FIG. 8 is a side view of the mechanism of FIG. 7, partly in cross section.

Referring to FIGS. 7 and 8, the mechanism is supported by frame members 50. Between the frame members 50, an electric motor 52 drives a gear wheel 53 via a reduction gear box 54. A shaft 56 is driven by a gear wheel 58 meshed with an idler gear wheel 59, also meshed with the gear wheel 53. The shaft 56 has a toothed pulley wheel (not visible in FIG. 6) by which it drives a toothed belt 60. The belt, which is tensioned by a roller 62 mounted on a shaft 64 drives a gear train 66 via a second toothed pulley wheel (again not visible in FIG. 6) mounted on a shaft 68.

Gear wheels 70 and 72 are formed as a cluster with the second pulley wheel being driven thereby to rotate together on the shaft 68. The cluster forms part of the gear train 66 which interlinks the movements of the back rest 36, the leg and foot rest 38, the arm rests 40, and the seat 34.

The back rest 36 is mounted on an arcuate member 74, see FIG. 8. The arcuate member 74 is mounted between rollers 76 and 78 for arcuate movement in the directions indicted by double arrow "A". The member 74 is hinged at 83 to enable the back rest to lift if, say, the dentist is caught under it when the chair is being reclined or lowered.

In FIG. 8 the arcuate member 74 is in, more or less, its fully raised position. Arcuate movement in a clockwise direction in FIG. 7 reclines the back rest through the position shown in FIG. 5 to the position shown in FIG. 6 in which the arcuate member would be retracted between the frame members 50. In order to provide such movement, the concave face of the arcuate member is provided with gear teeth 82 meshed with the teeth of the gear wheel 70.

The leg and foot rest 38, the arm rests 40, and the seat 34 are all driven by linkages from a shaft 84 which is driven by a train of gear wheels 86, 88 and 90 from the gear wheel 72 on the shaft 68. Each of the linkages is duplicated on both sides of the mechanism. For brevity, the linkages on one side only will be described.

In order to drive the leg and foot rest a crank is provided by a plate 100 mounted fixedly by splines on the shaft 84 for rotation therewith. A further crank is provided by an arm 102 mounted pivotally at the footrest end of the frame members. The two cranks are connected by a link 104 so that rotation of shaft 84 causes rotation of the crank 102 about its pivot 106. A further arm 108 is mounted for movement with the arm 102 in the directions indicated by the double arrow C, so that the two effectively constitute a bell crank. The leg and foot rest (not shown in FIG. 7) bears on the arms 108 (one on each side) and is pivotally mounted so as to rise and fall with the arms 108. The gear ratios and the proportions of the cranks are chosen so that while the back rest reclines from fully raised to fully reclined, the leg and foot rest rises from fully lowered to fully raised.

Figure 9:
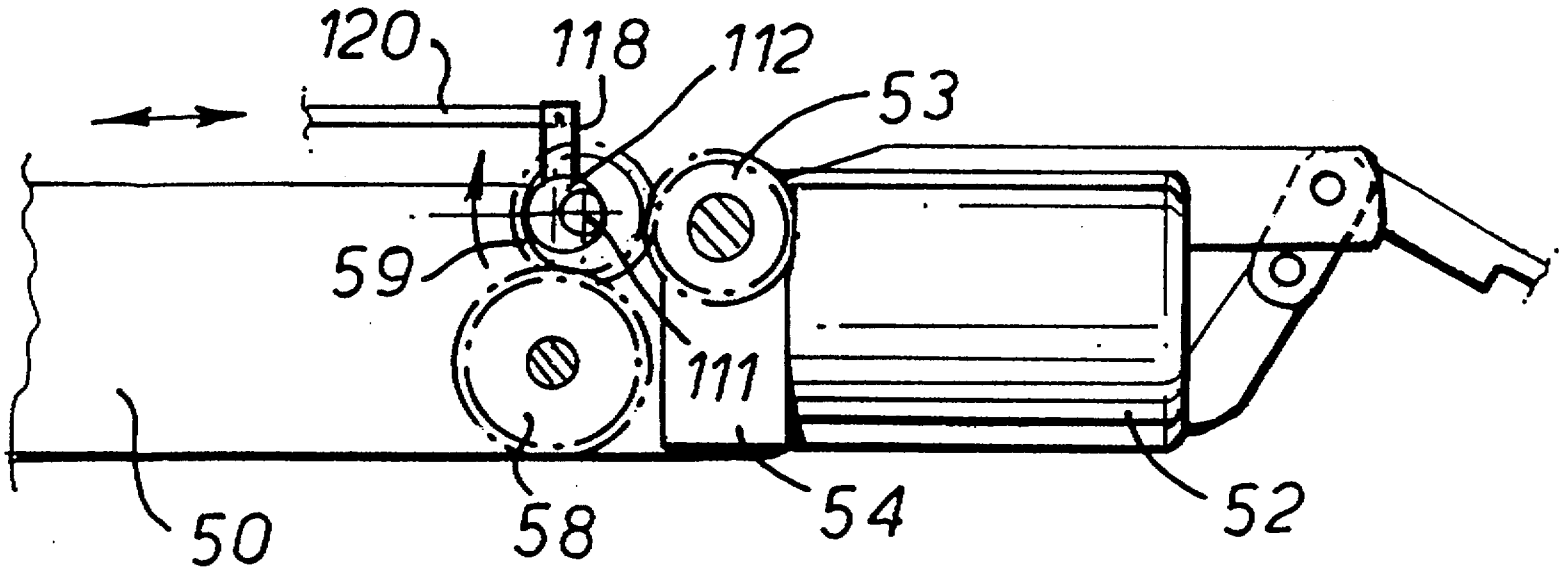
FIG. 9 is a detail of the mechanism for disengaging the motor.

Referring to FIGS. 8 and 9, the idler gear wheel 59 is mounted for rotation on an eccentric portion 111 of a shaft 112. The shaft 112 is mounted for rotation in the side frames 50. Such rotation of the shafts 112 is effected by means of arms 118 pivotally linked to a U-shaped operating handle 120. Pulling the handle 120 outwardly from the back of the chair, thus disengages the gears the idler gear 59 from 52 and 58. This frees the gear train 66 from the motor drive so that the chair can be quickly reclined in an emergency without waiting for the motor to drive it. Since the gear train still interlinks the back rest and the leg and foot rest, the leg and foot rest rises as the back rest is lowered.

Figure 12:
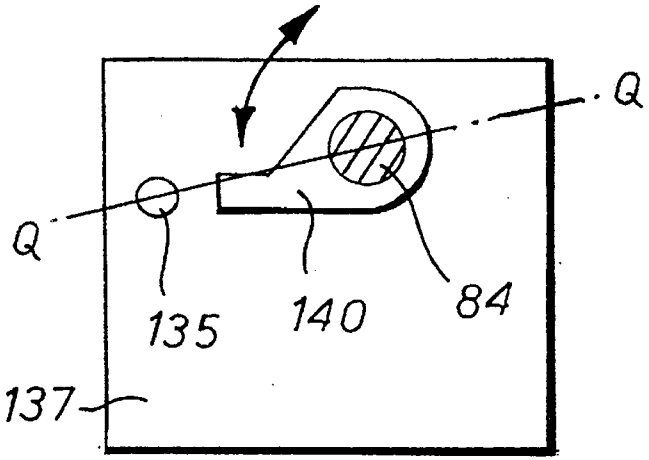
FIG. 12 is a detail of a part of a mechanism for raising and lowering the arm rests.
Figure 11:
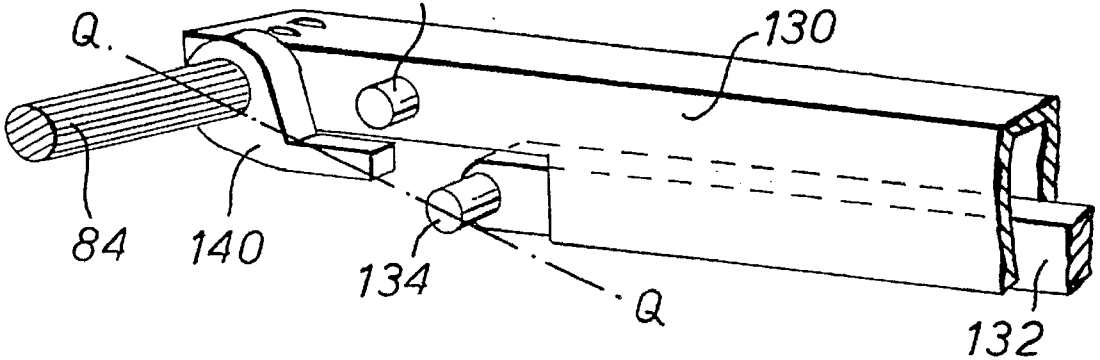
FIG. 11 is a pictorial view of supports for an arm rest of the chair of FIG. 4.

The arm rests 40 are mounted by a parallel linkage on the chair seat. Referring to FIG. 41, the linkage comprises two links 130 and 132 mounted for pivotal movement on the chair seat. The link 130 is mounted on, and for pivotal movement in relation to, the shaft 84. The link 132 is mounted for pivotal movement on a fixed plate 137 (see FIG. 12) by a pivot pin 134 which is rotatable in a bore 135 in the plate 137. The arm rest is mounted by pivot pins 136 and 138 at the remote ends of links 130 and 132. The centres of the pivot pins 136 and 138 are spaced the same distance apart as the centres of the shaft 84 and the pivot pin 134, and lines P—P and Q—Q joining the centres are parallel so that pivotal movement of the links maintains the arm rests horizontal.

Movement is effected by an arm 140 mounted fixedly by the splines on the shaft 84 for movement therewith. Upward movement of the arm 140 engages a pin 142 on the link 130 urging the arm rest upwards. The arrangement allows the arm rest to lift if, say, the dentist is trapped underneath it when the seat is relined. Being driven by the shaft 84' in common with the leg and foot rest, when the motor is disengaged by operation of the U-shaped handle 120, reclining the back rest also lowers the arm rests.

Figure 10:
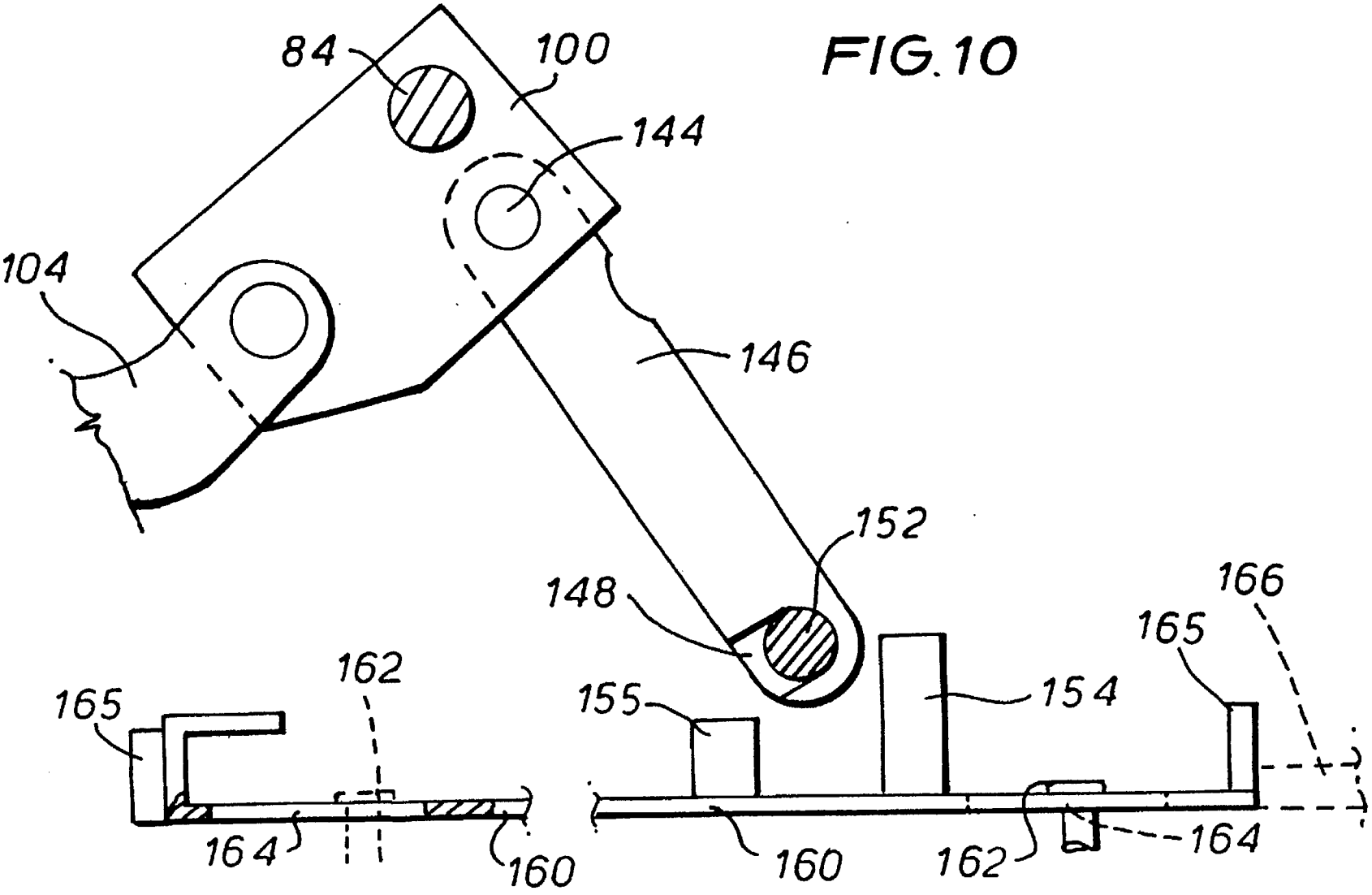
FIG. 10 is a detail of a mechanism for tilting the chair seat.

The mechanism which tilts the seat 34, but which selectively allows the seat to remain horizontal, is illustrated in FIG. 10. The plate 100 which provides the crank to raise and lower the leg and foot rest, also supports another off centre pin 144 which pivotally connects a link 146 to the plate 100. The other end of the link 146 has a slot 148 therein which forms a partly round aperture which, in normal operation as a dentist's chair, receives a shaft 152. As the shaft 84 rotates the plate 100 clockwise, as seen in FIG. 10 the pin 144 is lowered relative to the shaft 84. Since the pin 144 stays more or less at the same level, constrained by the link 146, the shaft 84 lifts thus tilting the seat.

On each side of the frame 50 a slider 160 is mounted by pins 162 slidable in slots 164, and linked by cross members 165. The sliders 160 are controlled by a second U-shaped handle 166. The sliders each carry two strikers 154 and 155.

Figure 5:
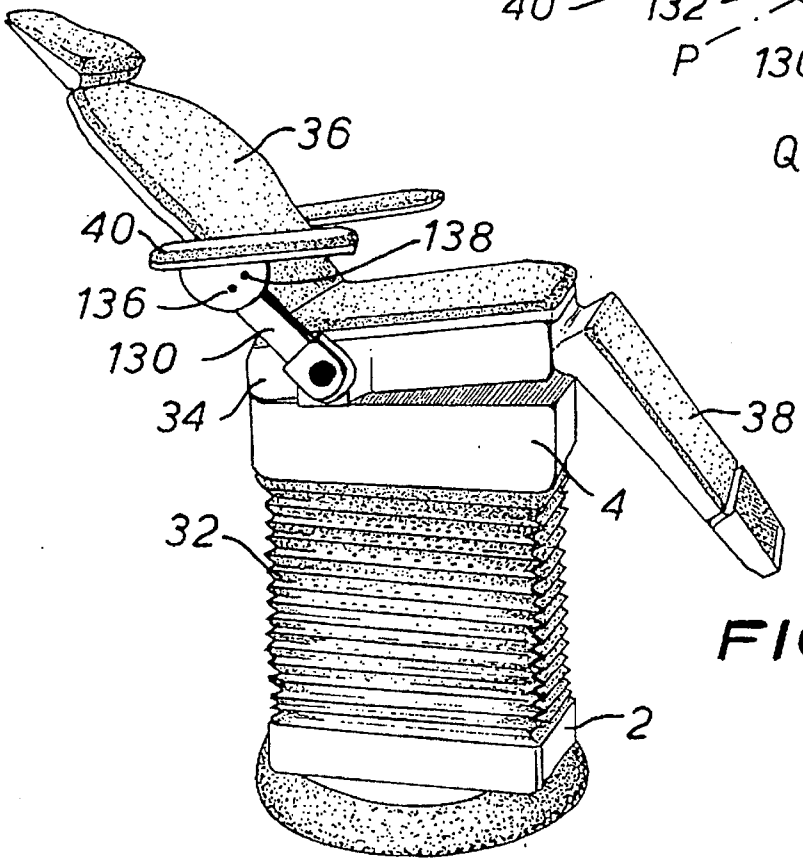
FIG. 5 is a pictorial view of a dentist's chair embodying the invention, showing the chair raised and partly reclined.

Sometimes, it is desirable to recline the seat fully and in that event, it is undesirable to have the seat tilted up. Before the seat is so relined, the U-shaped handle 166 is therefore operated so that the strikers 155 knock the link 144 off the shaft 152. This permits the link 146 to move downwards as the shaft 84 rotates anti-clock wise, which is the leg and foot rest raising direction, so that the seat does not tilt but remains flat. Thus, when the back rest 36 is fully relined and the leg and foot rest 38 is fully raised, the back rest, 36 seat 34 and leg and foot rest 38 are flat and horizontal, as illustrated in FIG. 5.

To return to normal operation, the handle 166 is returned to its initial position, so repositioning the link 146 that the shaft 152 is received by the slot 148.

We claim:

1. A dentist's or other chair including a back rest, a chair seat and a leg or foot rest and having a reclining mechanism interlinking the back rest, the chair sear and the leg or foot rest for raising and reclining the back rest, for tilting the chair seat, and for lowering and raising the leg or foot rest together, the mechanism further including means for disengaging the chair seat so that with the chair seat disengaged and horizontal, the back rest can be reclined and the leg or foot rest can be raised both also to horizontal.

2. A chair as claimed in claim 1 including a base, wherein said seat is mounted for tilting movement relative to said base, and wherein the mechanism comprises a shaft mounted in the chair seat, a crank mounted fixedly on the shaft for rotation therewith and connected pivotally to the base, so that rotation of the shaft also tilts the chair rest.

3. A chair as claimed in claim 2, wherein the means for disengaging the chair seat comprises means for selectively disconnecting the crank from the base so that the leg or foot rest may be selectively raised without tilting the chair seat.

4. A chair as claimed in claim 1, wherein the mechanism includes a rotatable shaft, and a linkage comprising: a crank mounted fixedly on the shaft for rotation therewith, a first arm mounted for pivotal movement with the leg or foot rest, and a link pivotally connected at one end to the crank and at the other end to the arm so that rotation of the shaft produces a pivotal movement in the arm to raise or lower the leg or foot rest.

5. A chair as claimed in claim 4, including a second arm mounted in fixed relationship to said first arm for movement therewith and against which the leg or foot rest is pivotally mounted so that the leg or foot rest may be raised relative to the second arm or may be held back as the second arm moves in a leg or foot rest lowering direction.

6. A chair as claimed in claim 1, wherein the mechanism is driven by an electric motor, and wherein the back rest depends from a generally arcuate member which is mounted for arcuate movement so as to raise and lower the back rest, the arcuate member including gear teeth arranged around the arc thereof in engagement with a gear wheel driven by the electric motor.

7. A chair as claimed in claim 6, wherein the generally arcuate member is mounted between rollers for arcuate movement.

8. A chair as claimed in claim 1, including a rotatable shaft and arm rests mounted on the chair seat by parallel links pivotally connected at one end to the chair seat and at the other end to the arm rest, one of said links being mounted for movement with rotational movement of the shaft so that movement thereof raises or lowers the arm rests whilst they remain generally horizontal.

9. A chair as claimed in claim 8, wherein said one link is pivotally mounted on the shaft, being raised by engagement with a crank mounted fixedly on the shaft for movement therewith, so that the arm rest may be lifted relative to the shaft mounted crank and so that the arm rest may be held back when the shaft is rotated in an arm rest lowering direction.

* * * * *